US008545040B2

(12) United States Patent
Berken

(10) Patent No.: US 8,545,040 B2
(45) **Date of Patent: *Oct. 1, 2013**

(54) FLASHLIGHT AND ILLUMINATED REAR SECTION WITH TWO-SIDED LIGHTING MODULE

(71) Applicant: Life+Gear, Inc., Del Mar, CA (US)

(72) Inventor: Dennis Berken, Del Mar, CA (US)

(73) Assignee: Life+Gear, Inc., Del Mar, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/672,623

(22) Filed: Nov. 8, 2012

(65) Prior Publication Data

US 2013/0063931 A1 Mar. 14, 2013

Related U.S. Application Data

(63) Continuation of application No. 12/572,558, filed on Oct. 2, 2009, now Pat. No. 8,360,596.

(60) Provisional application No. 61/102,338, filed on Oct. 2, 2008.

(51) Int. Cl.
*F21L 4/02* (2006.01)

(52) U.S. Cl.
USPC ..... 362/184; 362/120; 362/157; 362/186; 362/202; 362/217.01; 362/227; 362/249.02

(58) Field of Classification Search
USPC ..... 362/120, 157, 202, 203, 217.01, 362/227, 249.01, 249.302
See application file for complete search history.

(56) References Cited

U.S. PATENT DOCUMENTS

| | | | | |
|---|---|---|---|---|
| 2,340,530 | A | 2/1944 | Hefner | |
| 2,375,511 | A * | 5/1945 | Wood | 362/157 |
| 2,959,667 | A * | 11/1960 | Cheng | 362/184 |
| 4,249,234 | A | 2/1981 | Park et al. | |

(Continued)

FOREIGN PATENT DOCUMENTS

| | | |
|---|---|---|
| CN | 2499685 Y | 7/2002 |
| CN | 2514455 | 10/2002 |

(Continued)

OTHER PUBLICATIONS

Supplementary European Search Report for European Application EP 08 82 5096, 3 pages, mailed Mar. 31, 2011, The Hague, Netherlands.

(Continued)

*Primary Examiner* — John A Ward
(74) *Attorney, Agent, or Firm* — Marger, Johnson & McCollom, P.C.

(57) ABSTRACT

A multipurpose lighting device comprising a flashlight end, a lantern end including a barrel through which light may pass, and a module mounted between the flashlight end and lantern end. The module includes a first light source configured to direct light out the flashlight end, and a second light source configured to direct light out the lantern end. The second light source is disposed on an opposite end of the module from the first light source. The module further includes a power source configured to energize the first light source and second light source, wherein the second light source is oppositely disposed on the module from the first light source.

18 Claims, 9 Drawing Sheets

(56) References Cited

U.S. PATENT DOCUMENTS

| | | | | |
|---|---|---|---|---|
| 4,697,228 | A | 9/1987 | Mui et al. | |
| 4,744,013 | A | 5/1988 | Lee et al. | |
| 4,977,489 | A | 12/1990 | Fung | |
| 5,010,454 | A | 4/1991 | Hopper | |
| 5,079,679 | A | 1/1992 | Chin-Fa | |
| 5,412,548 | A | 5/1995 | Yee | |
| 5,622,423 | A | 4/1997 | Lee | |
| 5,735,594 | A | 4/1998 | Own | |
| 5,806,961 | A | 9/1998 | Dalton et al. | |
| 5,860,729 | A | 1/1999 | Bamber | |
| 5,879,076 | A | 3/1999 | Cross | |
| 5,980,063 | A | 11/1999 | Ford et al. | |
| 6,179,431 | B1 | 1/2001 | Chien | |
| 6,213,623 | B1 | 4/2001 | Campman | |
| 6,231,207 | B1 | 5/2001 | Kennedy et al. | |
| 6,371,625 | B2 | 4/2002 | Campman | |
| 6,623,140 | B2 | 9/2003 | Watterson et al. | |
| 6,722,771 | B1 | 4/2004 | Stephens | |
| 6,942,362 | B1 | 9/2005 | Deutsch et al. | |
| 7,140,746 | B2 | 11/2006 | Chen | |
| 7,148,746 | B2 | 12/2006 | Louis | |
| 7,198,382 | B2 | 4/2007 | Donovan | |
| 7,267,453 | B2 | 9/2007 | Chang et al. | |
| 7,347,581 | B2 | 3/2008 | Krieger | |
| 7,566,157 | B2 | 7/2009 | Lo | |
| 7,845,820 | B2 * | 12/2010 | Bertken | 362/217.01 |
| 8,113,682 | B2 * | 2/2012 | Bertken | 362/217.01 |
| 8,186,846 | B2 * | 5/2012 | Bertken | 362/217.01 |
| 2001/0015893 | A1 | 8/2001 | Campman | |
| 2002/0149928 | A1 | 10/2002 | Watterson et al. | |
| 2002/0196622 | A1 | 12/2002 | Klees | |
| 2004/0264172 | A1 | 12/2004 | Roberts | |
| 2005/0046582 | A1 | 3/2005 | Kessel et al. | |
| 2006/0082988 | A1 | 4/2006 | Riblett et al. | |
| 2006/0203478 | A1 | 9/2006 | Waters | |
| 2006/0221605 | A1 | 10/2006 | Theriault | |
| 2007/0019398 | A1 | 1/2007 | Chen et al. | |
| 2007/0153512 | A1 | 7/2007 | Hendrie | |
| 2008/0094822 | A1 | 4/2008 | Hsu | |
| 2008/0304258 | A1 | 12/2008 | McMillan et al. | |
| 2010/0027249 | A1 | 2/2010 | Connor et al. | |
| 2010/0157582 | A1 | 6/2010 | Bertken | |

FOREIGN PATENT DOCUMENTS

| | | |
|---|---|---|
| CN | 2842604 | 11/2006 |
| EP | 0921345 | 6/1999 |
| EP | 0746718 | 11/2001 |
| GB | 2353853 | 7/2001 |
| JP | 4215593 | 5/1971 |
| JP | 53149483 | 11/1978 |
| JP | 198687402 | 6/1986 |
| JP | 2003009755 | 1/2003 |
| JP | 3095393 | 7/2003 |
| KR | 20050083275 | 8/2005 |
| WO | 0045086 | 8/2000 |
| WO | 0161238 | 8/2001 |
| WO | 2005073616 | 11/2005 |

OTHER PUBLICATIONS

International Search Report and Written Opinion for PCT Application No. PCT/US2011/026735, 13 pages, mailed Apr. 26, 2011, Alexandria, Virginia, USA.

International Search Report and Written Opinion for PCT Application No. PCT/US2011/026738, 11 pages, mailed Apr. 26, 2011, Alexandria, Virginia, USA.

* cited by examiner

FLASHLIGHT AND ILLUMINATED REAR SECTION WITH TWO-SIDED LIGHTING MODULE

CROSS-REFERENCES TO RELATED APPLICATIONS

This application is a continuation of co-pending U.S. patent application Ser. No. 12/572,558, filed on Oct. 2, 2009, which claims the benefit of U.S. Provisional Patent Application No. 61/102,338 filed Oct. 2, 2008 whose contents are incorporated herein for all purposes.

BACKGROUND OF THE INVENTION

1. Field of the Invention

This invention relates generally to lighting sources and more particularly to a light source with flashlight, e.g. for projecting a beam of light, and lantern function, e.g. for a 360 degree light source.

2. Description of the Prior Art

Portable lighting is typically designed with the task in mind. Accordingly, flashlights are designed to focus a beam of light for peering into dark corners or cast light longer distances. In contrast, lanterns are designed for general lighting to cast light short distances but in all directions.

Conventional flashlights are designed to be powered by batteries installed within a barrel of the flashlight rearwardly of the light source. Because of this placement of the batteries with respect to the light source, it is generally impossible for the flashlight to also be tasked to provide lantern-like lighting in a full circle. Instead, and because the battery placement would block at least some of the light from the light source, such devices are designed to provide general task lighting at an obtuse angle rather than one that is greater than 180 degrees much less a full 360 degrees.

Accordingly, the need exists for a combination lighting device that fulfills both a flashlight function and a lantern function to maximize illumination.

SUMMARY OF THE INVENTION

In various representative aspects, the present invention describes a multipurpose lighting device.

A multipurpose lighting device comprising a flashlight end, a lantern end including a barrel through which light may pass, and a module mounted between the flashlight end and lantern end. The module includes a first light source configured to direct light out the flashlight end, and a second light source configured to direct light out the lantern end. The second light source is disposed on an opposite end of the module from the first light source. The module further includes a power source configured to energize the first light source and second light source, wherein the second light source is oppositely disposed on the module from the first light source.

A module housing encloses the module and including a housing button located on the outside of the housing that aligns with the button coupled to the module. Actuating the housing button also serves to actuate the module button so that the multipurpose lighting device is operated. Furthermore, the second light source may emit a colored light. Also, successive actuations of the button may operate the device to operate the first light source only, the second light source only, or the second light source in a repeating flash mode.

The foregoing and other objects, features and advantages of the invention will become more readily apparent from the following detailed description of a preferred embodiment of the invention that proceeds with reference to the accompanying drawings.

DETAILED DESCRIPTION

Figure 1:
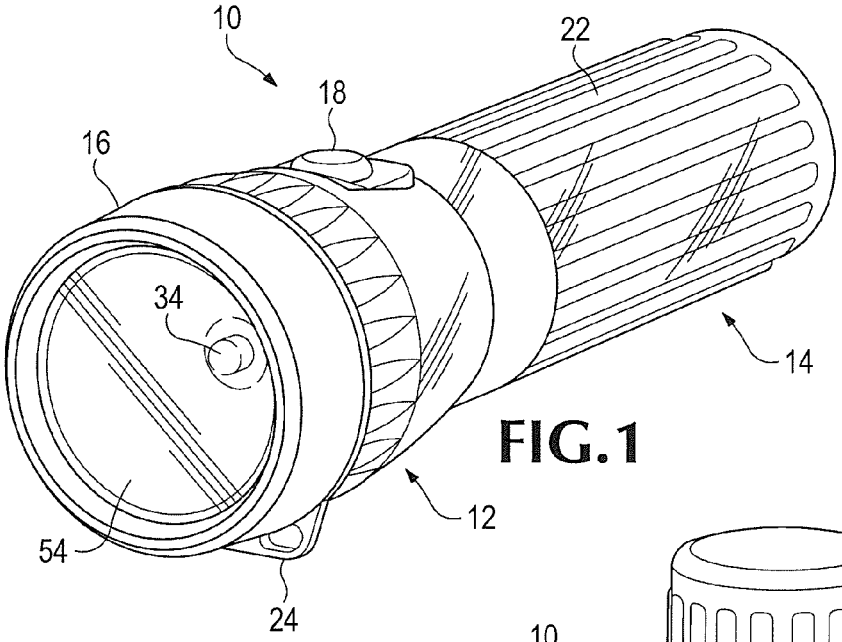
FIG. 1 is a front perspective view of a lighting device implemented according to a preferred embodiment of the invention.
Figure 2:
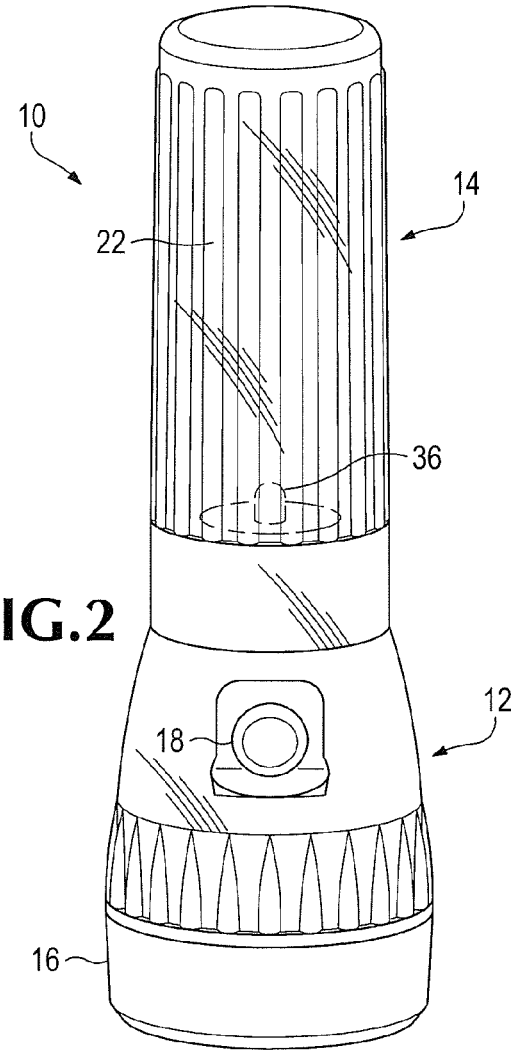
FIG. 2 is a rear perspective view of the lighting device of FIG. 1 implemented according to a preferred embodiment of the invention.
Figure 4:
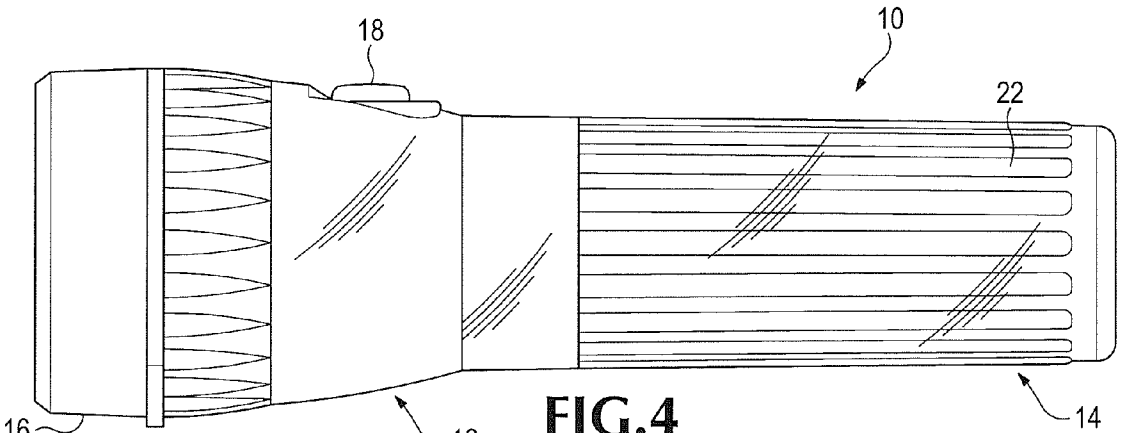
FIG. 4 is a side-elevation view of the lighting device of FIG. 1.
Figure 6:
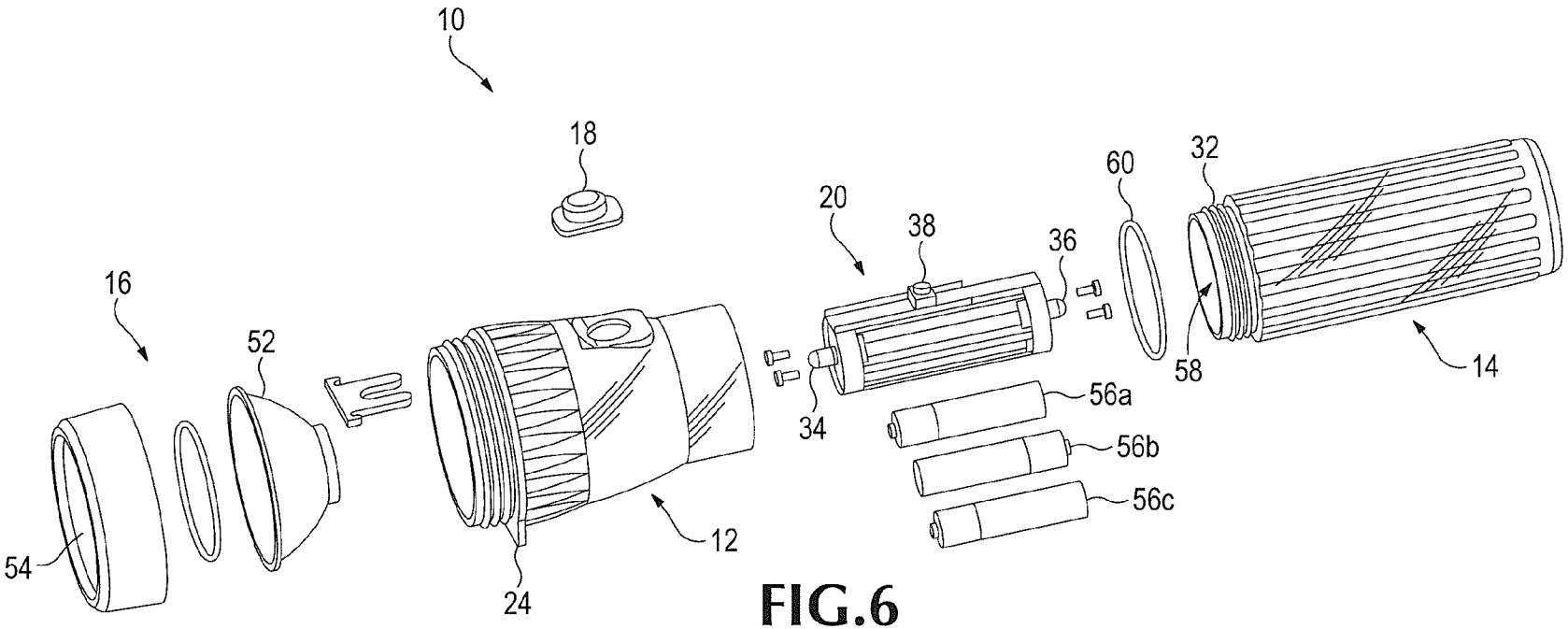
FIG. 6 is a fully exploded view of the lighting device of FIG. 1.
Figure 9:
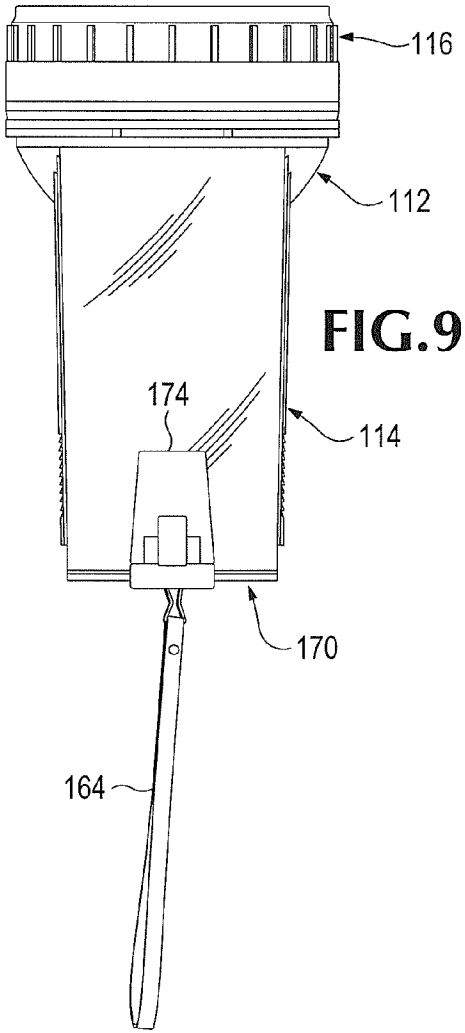
FIGS. 7-15 illustrate various views of an alternate form factor from the embodiment of FIGS. 1-6 implementing a two-sided lighting module per the teachings of the invention and also including a trapdoor feature.
Figure 8:
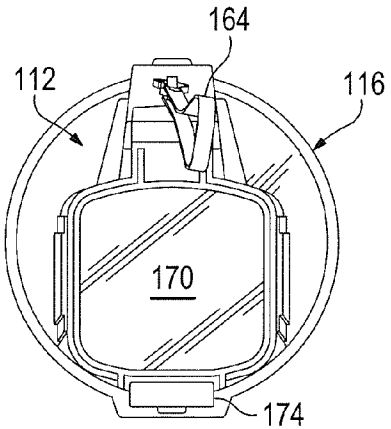

FIGS. 1, 2, and 4 illustrate a multipurpose lighting device 10 according to a preferred embodiment of the invention. Device 10 is comprised of a device body having a front housing comprising an opaque module housing 12 and end cap 16 defining a flashlight end, and a rear housing in a lantern end of the device 10 defining a transparent or translucent barrel 14 through which light is capable of passing along a substantial length of the barrel 14. The barrel 14 is releasably affixed to the module housing 12 as by threading the barrel 14 into housing 12 (as shown in FIG. 6) or via hooks on the barrel 14 that engage with housing 12 when inserted and rotated a quarter turn.

A button 18 is defined on a surface of the module housing 12 and interfaces with a button on a lighting module 20 (FIG. 3) as will be described further below. The lantern housing 14 includes multiple ribs 22 running along the length of and spaced circumferentially about the barrel 14. The ribs 22 act to provide a non-slip grippable surface and further assist in dispersing light emitted from a rearwardly directed second light source 36 (FIG. 3) that passes through the transparent or translucent sidewalls of the lantern portion of the device 10. A flange 24 is fixed at an end of the module housing 12 and couples with a detachable wrist strap (not shown).

Figure 3:
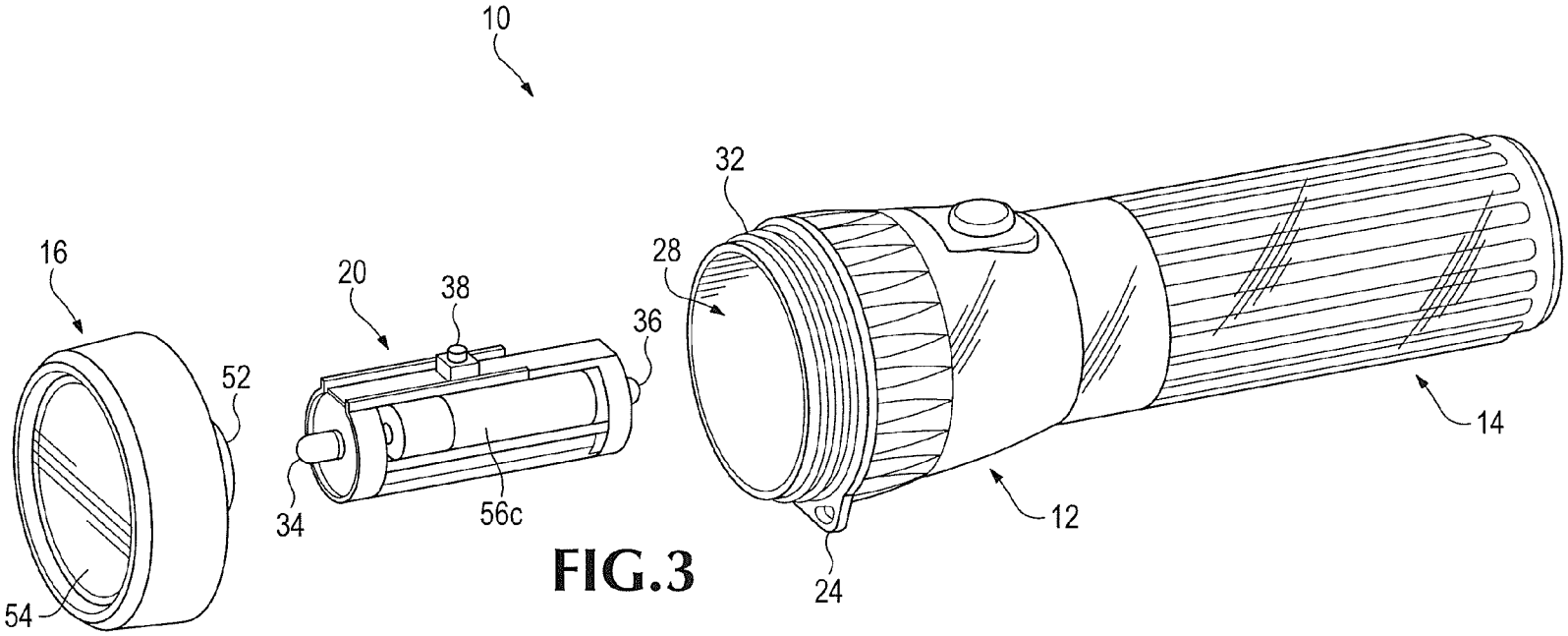
FIG. 3 is a partial exploded front perspective view of the lighting device of FIG. 1.

As illustrated in FIG. 3, the module housing 12 defines a hollow interior 28 into which the lighting module 20 is installed. Female threads (FIG. 5) formed on the inside walls of the end cap 16 mate with male threads (FIG. 3) formed on the end of the module housing 12, thereby enclosing the interior 28 and fixing the lighting module 20 within the lighting device 10.

The lighting module includes two opposable light sources, shown by flashlight LED 34 and lantern LED 36. Both light sources 34, 36 are actuated by a button 38 formed on the lighting module that, itself, is aligned with an actuated by the button 18 formed on the module housing 12.

FIG. 3 shows the end cap 16 removed from the end of the module housing 12. As will be appreciated, the multipurpose lighting device 10 includes a flashlight function, and a lantern function where the power source (e.g. batteries 56*a*, 56*b*, 56*c* [FIG. 6]) does not interfere with the lantern light source so that it is capable of casting light in all radial directions out the lantern end of the device. The device thus provides a useful multipurpose tool for emergencies or just general use.

Figure 5:
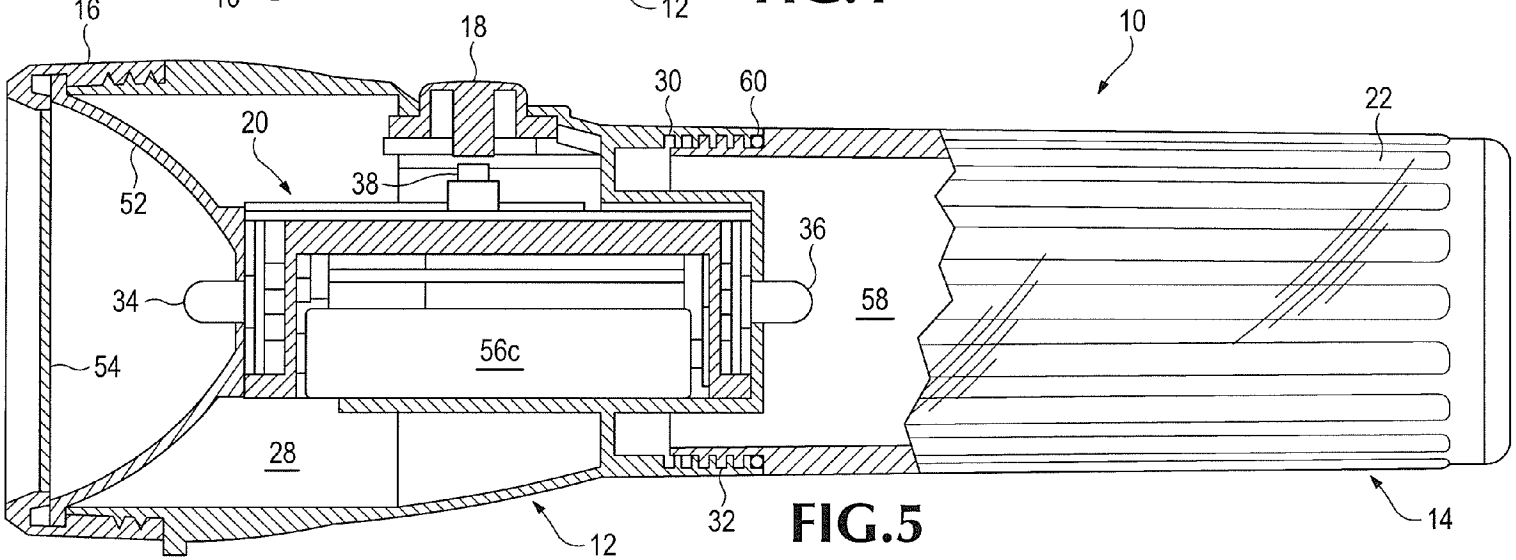
FIG. 5 is a side-section view of the lighting device of FIG. 1.

Turning to FIGS. 5 and 6, the lighting module 20 is shown installed within the module housing 12 of the device 10. Module 20 may include a rounded lower end terminating in elongate ridges running the length of the module. Complementary molded portions may be formed on inside walls of the cavity 28 that are slidingly engaged with the ridges when the lighting module 20 is installed. The cavity 28 of the module housing 12 is thus shaped by the molded portions 50*a*, 50*b* and by the dimensions of the cavity to locate the lighting module at a specific point so that (a) the lighting module button 38 is aligned with the button 18 formed on the outside of the module housing 12, and (b) the flashlight LED 34 inserts properly within a shaped reflector 52 so that the light may be focused and projected outward through a forward-facing lens or transparent front 54 located within cap 16. A power source, such as batteries 56*a*, 56*b*, and 56*c*, is installed within the lighting module 20 to power the LEDs 34, 36 and electronics necessary to selectively actuate the lights according to the table below.

As shown in FIG. 5, button 18 includes an elastomeric top portion that resiliently deforms under downward pressure to force a hard contact against the aligned button 38 of the lighting module 20. Multiple clicks on the button 38 operate control electronics within the module to function progressively as shown in Table 1 below, namely:

TABLE 1

Button Operation of the Device

| Button Press | Operation |
|---|---|
| 1 | flashlight LED 34 turned ON (lantern LED 36 remains OFF) |
| 2 | lantern LED 36 turned ON (flashlight LED 34 remains ON) |
| 3 | flashlight LED 34 turned OFF (lantern LED 36 remains ON) |
| 4 | lantern LED 36 FLASHED intermittently as emergency light (flashlight LED 34 remains OFF) |
| 5 | lantern LED 36 turned OFF (flashlight LED 34 remains OFF) |
| 6 | cycle back to operation for button press 1 |
| . . . | |

The above operations are examples of use and not all are required to fulfill the spirit of the invention or required for implementation.

Turning lastly to the lantern operation, and as shown best in FIG. 5, lantern LED 36 illuminates within the elongate chamber 58 formed within the lantern housing 14. It is preferred that the chamber 58 be hollow and removable from module housing 12 so that it may be used as an illuminated storage chamber. Light emitted from the LED 36 is internally reflected within the elongate lantern chamber 58 and scatters out the sidewalls of the housing 14 to form a fairly even glow along its length. That is, the lantern LED 36 is directed along a long axis of the barrel 14 and radiates radially from the barrel along its periphery to result in a lantern that radiates in 360 degrees from along the long axis. Alternately, the lantern LED 36 is configured to emit light omni-directionally into the hollow elongate chamber 58 and out the sidewalls of the barrel 14. The whole, with ribs 22, operates to better diffuse the illumination along the entire length of the lantern housing 14. In this way, the housing may or may not include the hollow interior 58, and may or may not include a solid core (not shown) of a diffusive and/or light scattering material.

In a preferred embodiment, LED 36 gives off a colored light (e.g. red or blue). Alternately, LED 36 can emit a white light and the lantern housing 14 can be formed of a colored translucent or transparent plastic material. As shown best in FIG. 6, lantern housing 14 includes an O-ring 60 on an outside wall that bears against the inside wall of module housing 12 when the two housings are screw-fitted together. The O-ring 60 helps to prevent water from seeping into the hollow interior 28 of the module housing 12 and thereby adversely affecting the lighting module.

The multipurpose lighting device is useful in that it uses, in its preferred implementation, a single power source and actuator (e.g. button 18) to alternately operate a flashlight and lantern. In special emergencies, therefore, a single device can thus project light a far distance (flashlight), provide general lighting (lantern), or flash colored light in all directions. The multipurpose lighting device is further useful in that it may include a hollow storage chamber 58 for holding items such as keys, first aid materials, etc. and that such items may be illuminated by the lantern LED 36 when actuated by button 18. Access to the hollow storage chamber 58 within the lantern end 14 of the lighting device 10 may be by disengaging the lantern end 14 from the module housing 12 of the device. In the embodiment shown in FIG. 6, threads 32 formed on an outside of the barrel 14 engage with complementary threads 30 on the inside of the housing 12. In alternate embodiments, hooks (not shown) formed on the barrel engage with complementary structures within the module housing when the barrel is inserted and then turned within the housing 12.

FIGS. 7-12 illustrate perspective, rear, top and side elevations of a spotlight form factor 110 implementing the teachings of the invention. The outer shell of the spotlight device 110 includes similar general features as that described above with respect to flashlight 10. A module housing 112 and end cap 116 define the flashlight (front) end of the housing. The translucent lantern end 114 of the housing encloses a hollow chamber 128 (FIG. 15) accessible by a trapdoor 170 hingedly attached to the rear portion of the lantern end 114 of the device housing.

Figure 7:
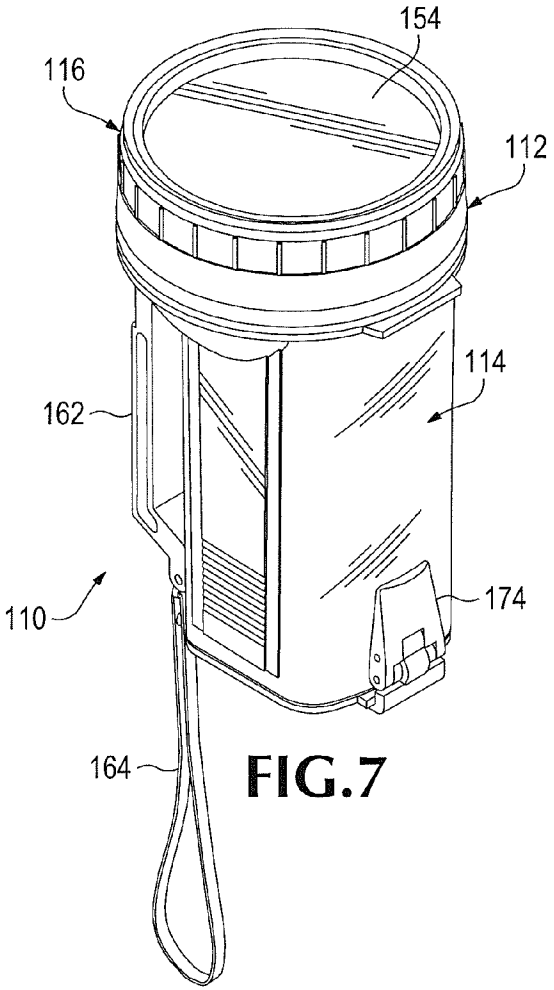
Figure 12:
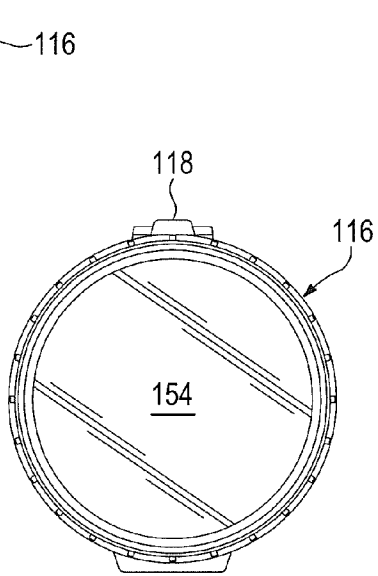
Figure 11:
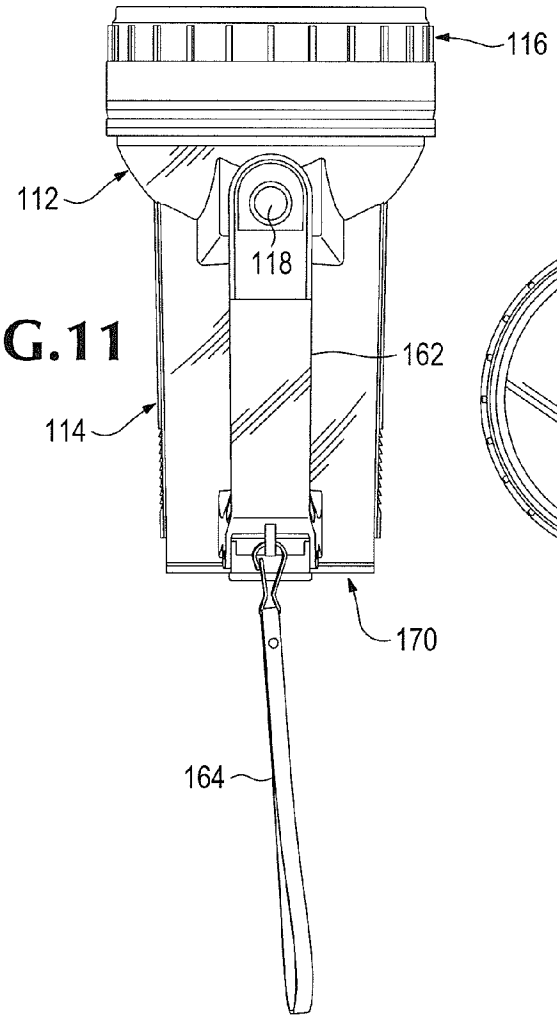
Figure 10:
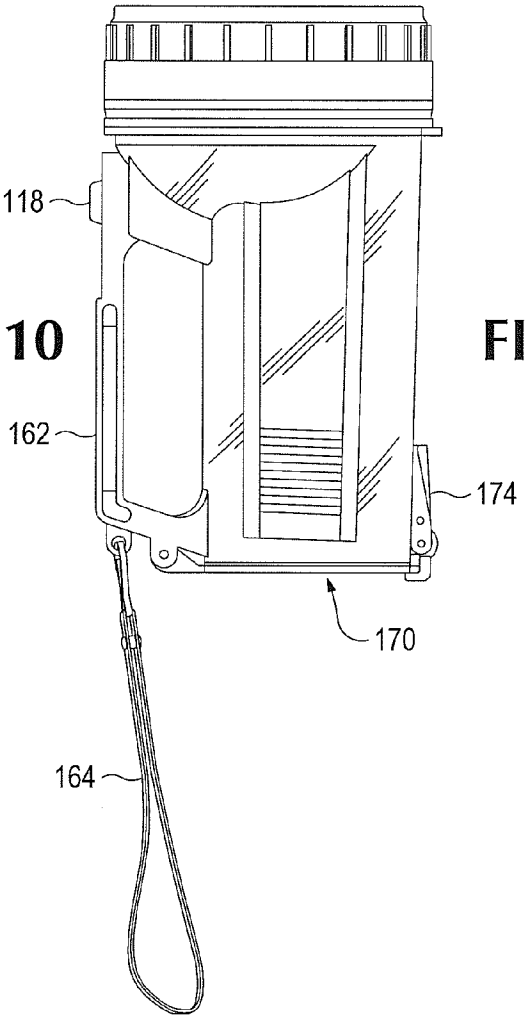

FIG. 7 is a perspective view of spotlight 110. The flashlight end of the housing 112 has a general circular shape and retains (as shown in the exploded view of FIG. 13) the lighting module 120, reflectors 152, and transparent lens 158 configured to project one or more beams of light forwardly of the device 110. The lantern (rear) portion of the device 110 has a generally square cross-section and includes a handle 162 and wrist strap 164. The outer shell of the lantern end 114 is made of a translucent material so that light shown into the interior cavity 128 of the rear portion is transmitted through the exterior surfaces of the shell.

Figure 13:
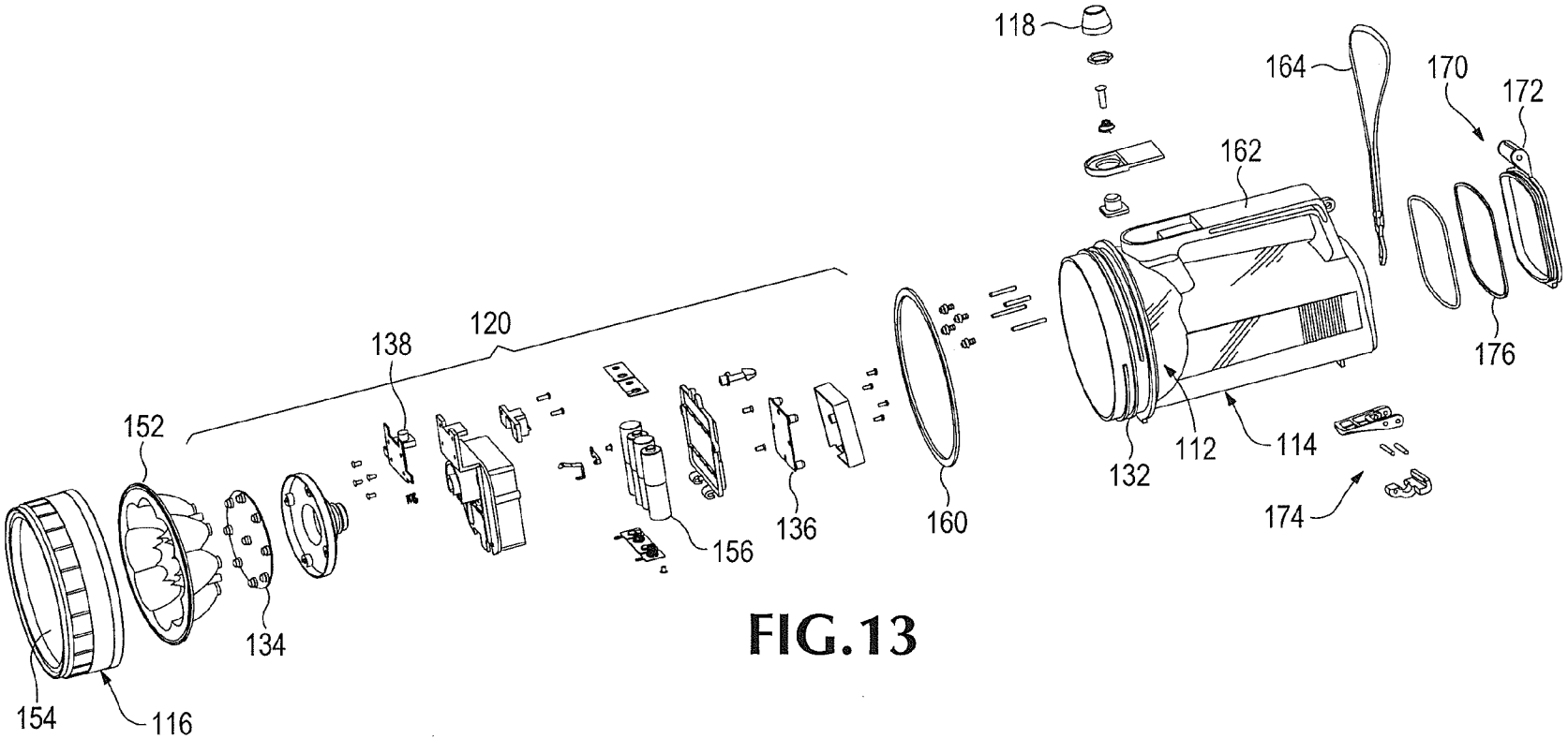

FIG. 13 is an exploded view showing assembly of the components of the spotlight device 110. A lighting module 120, installed within the module housing 112 of the device 100, includes among other elements a forward-facing bank of LEDs 134, batteries 156, and a rear-facing bank of LEDs 136. Each of the LEDs within the forward-facing bank of LEDs 134 are received within respective reflector portions of reflector 152 so that each are individually focused forwardly. A rubber O-ring 160 is received around the threads 132 of the housing 112 so that the seal between the cap 116 and housing 112 is watertight when the cap and housing are screw-fitted together. An elastomeric button 118 and complementary parts interfaces with a button 138 on lighting module 120 for operating the lights of the module. The button may be coupled to a timer circuit that maintains the LEDs in an on position for only a preset amount of time after which point the LEDs turn off in order to save power should the button be inadvertently activated and left as may take place in a retail environment where a customer tries the light but forgets to turn it off.

Finally, a trapdoor 170 is attached via hinge 172 to the back end of lantern end 114 so that it pivots up out of the way for access to an interior cavity within the end 114. The trapdoor 170 is releasably retained in a closed position via clasp 174, buckle, key, or other contemplated device. One or more O-rings 176 are captured between the trapdoor 170 and rear face of the opening to effect a water-tight seal.

Figure 14:
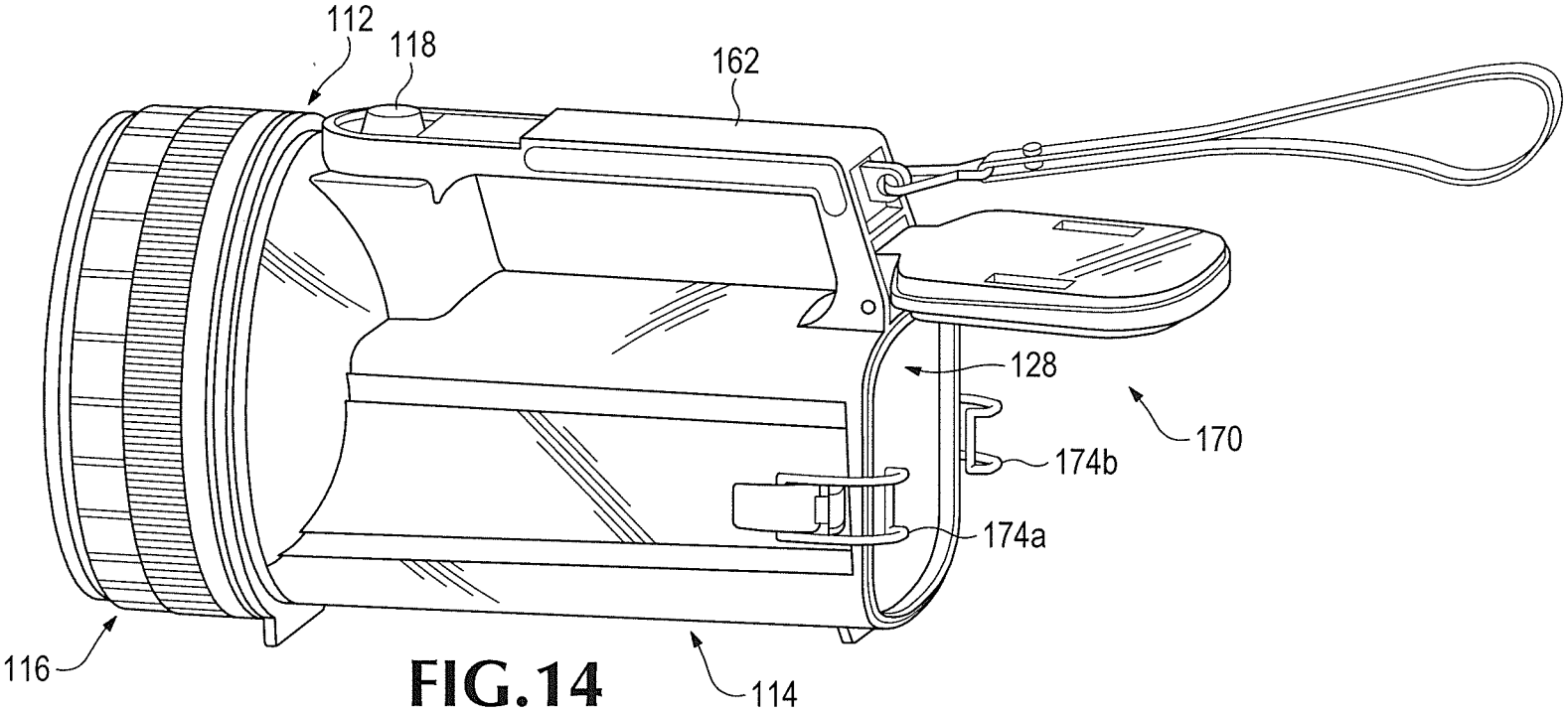

FIG. 14 is a perspective view showing the spotlight device 110 with the trapdoor 170 opened and two clasps 174*a*, 174*b* released.

Figure 15:
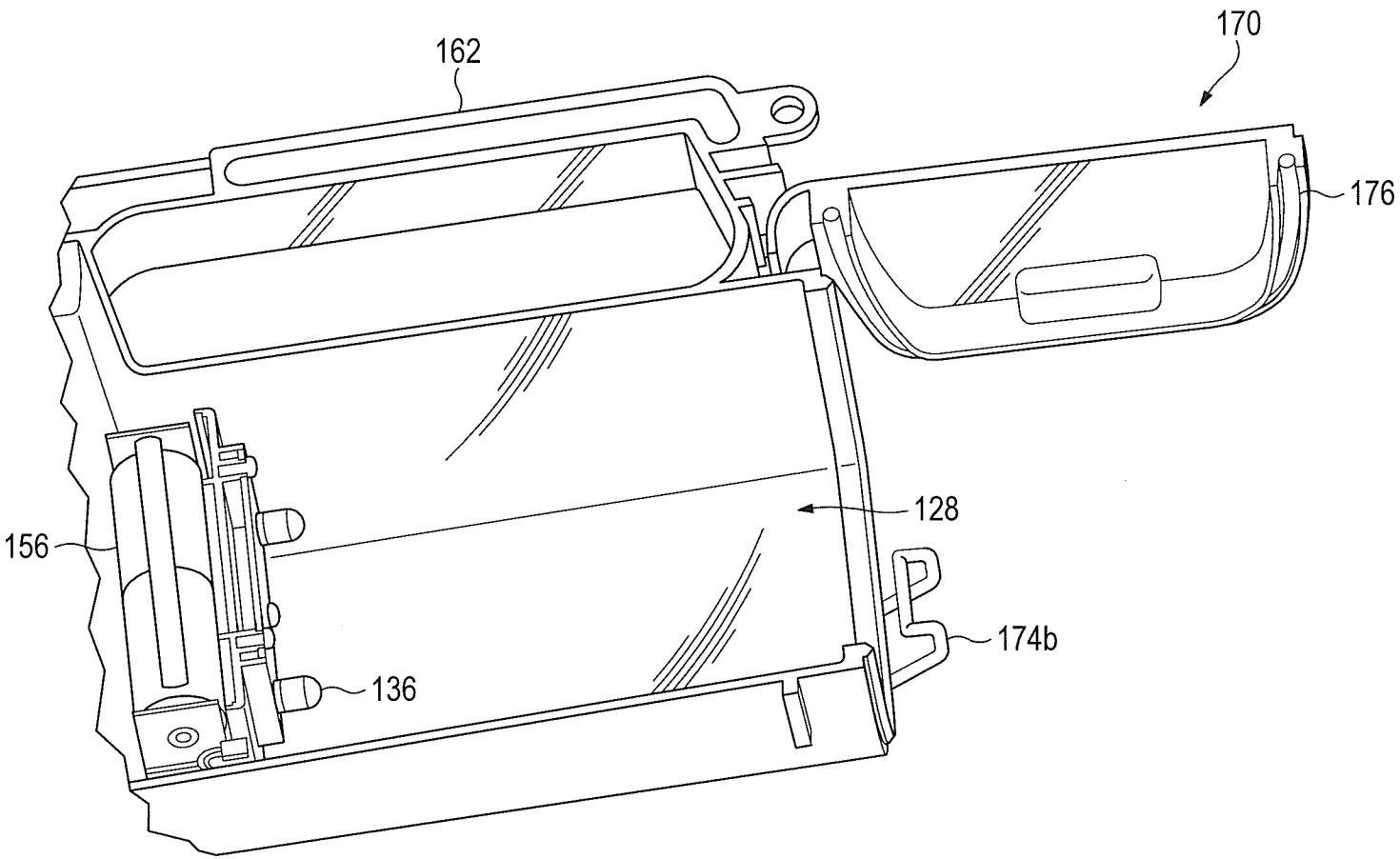

FIG. 15 shows a sectioned view of the spotlight device 110 of FIG. 14. The trapdoor 170 pivots out of the way to access the interior storage compartment 128 of the spotlight 110. This compartment 128 may be further illuminated by the rear-facing bank of LEDs 136.

Having described and illustrated the principles of the invention in a preferred embodiment thereof, it should be apparent that the invention can be modified in arrangement and detail without departing from such principles. We claim all modifications and variation coming within the spirit and scope of the invention.

What is claimed is:

1. A multipurpose lighting device comprising:

a flashlight end;

a lantern end including an elongate barrel through which light may pass; and an integrated module mounted as a unit within a module housing adjacent the flashlight end and a proximal end of the barrel, said module including:

a first light source configured to direct light out the flashlight end;

a second light source configured to direct light along the barrel and out the lantern end and disposed on an opposite end of the module from the first light source; and a power source configured between the first light source and second light source to energize the first light source and second light source.

2. The multipurpose lighting device of claim 1, further including a button electrically coupled to both the first light source and the second light source of the module for selectively alternating between the first and second light sources.

3. The multipurpose lighting device of claim 2, wherein successive actuations of the button operate the device to operate the first light source only, the second light source only, or the second light source in a repeating flash mode.

4. The multipurpose lighting device of claim 1, wherein the barrel is transparent or translucent along a substantial length of the barrel and around a full periphery of the barrel so that light is radiated in 360 degrees around a long axis of the barrel.

5. The multipurpose lighting device of claim 1, further including an opaque module housing containing the module and a reflector adjacent the first light source for focusing light from the first light source out a transparent member at a front of the flashlight end.

6. The multipurpose lighting device of claim 1, wherein the second light source emits a colored light different from the first light source.

7. The multipurpose lighting device of claim 1, wherein the barrel includes an interior cavity into which the second light source shines.

8. The multipurpose lighting device of claim 7, wherein the barrel is releasably coupled to the flashlight end so that the interior cavity can be exposed for storage of items within the cavity and recoupled to the flashlight end.

9. The multipurpose lighting device of claim 7, wherein the barrel includes a trapdoor to access the interior cavity coupled to a rear end of the barrel distal to the flashlight end, said trapdoor configured to selectively expose the interior cavity for storage of items within the cavity or removal of the items from the cavity.

10. A method for operating a lighting device, the method comprising:

selectively powering a first light source and a second light source within an integrated module from a single button;

focusing light from the first light source out a first end of the lighting device;

diffusing light from the second light source out a second end of the lighting device, wherein the first end is opposed to the second end.

11. The method of claim 10, further including the steps of:

providing an interior cavity at a second end of the lighting device;

storing items within the interior cavity; and illuminating items within the interior cavity using the second light source.

12. The method of claim 11, further including the steps of:

providing a closeable opening at a rear end of the second end of the lighting device;

moving a trapdoor from the opening to expose the interior cavity;

inserting items within the interior cavity through the opening; and closing the trapdoor across the opening to retain the items within the interior cavity.

13. The method of claim 10, further including the step of alternately activating the first light source and the second light source.

14. The method of claim 10, further including the step of automatically deactivating either of the first or second light source after a preset period of time.

15. A multipurpose lighting device comprising:

a lighting device housing having a first end and a second end;

an integrated module having a module housing mounted as a unit within the lighting device housing adjacent the first end, said module including:

a first light source configured to direct light out the first end;

a second light source configured to direct light out the second end and disposed on an opposite end of the module from the first light source;

a power source configured between the first light source and second light source to energize the first light source and second light source; and a button electrically coupled to both the first light source and the second light source of the module for selectively alternating between the first and second light sources.

16. The multipurpose lighting device of claim 15, wherein successive actuations of the button operate the device to operate the first light source only, the second light source only, or the second light source in a repeating flash mode.

17. The multipurpose lighting device of claim 15, the lighting device further including a first part and a second part that are releasably coupled together to form an interior cavity primarily within the second part, wherein the interior cavity can be exposed for storage of items within the cavity and thence recoupled to the first part.

18. The multipurpose lighting device of claim 15, the lighting device further having an interior cavity located adjacent the second end of the lighting device housing and further including a trap door located on the second end configured to pivot up out of the way for access to the interior cavity and selectively expose the interior cavity for storage of items within the cavity or removal of the items from the cavity.

* * * * *

UNITED STATES PATENT AND TRADEMARK OFFICE

CERTIFICATE OF CORRECTION

PATENT NO. : 8,545,040 B2
APPLICATION NO. : 13/672623
DATED : October 1, 2013
INVENTOR(S) : Dennis Bertken It is certified that error appears in the above-identified patent and that said Letters Patent is hereby corrected as shown below:

On the title page item [75] delete "Inventor: Dennis Berken, Del Mar, CA (US)", and insert --Inventor: Dennis Bertken, Del Mar, CA (US)--.

Signed and Sealed this
Twelfth Day of November, 2013

Teresa Stanek Rea

Teresa Stanek Rea
*Deputy Director of the United States Patent and Trademark Office*